US008345039B2

(12) United States Patent
Choi et al.

(10) Patent No.: US 8,345,039 B2
(45) Date of Patent: Jan. 1, 2013

(54) ORGANIC LIGHT EMITTING DISPLAY DEVICE AND METHOD OF DRIVING THE SAME

(75) Inventors: Sang-Moo Choi, Suwon-si (KR); Hun-Jung Lee, Suwon-si (KR); Su-Young Kim, Suwon-si (KR); Dong-Wook Choi, Suwon-si (KR)

(73) Assignee: Samsung Display Co., Ltd., Giheung-Gu, Yongin, Gyeonggi-Do (KR)

( * ) Notice: Subject to any disclaimer, the term of this patent is extended or adjusted under 35 U.S.C. 154(b) by 740 days.

(21) Appl. No.: 12/585,966

(22) Filed: Sep. 29, 2009

(65) Prior Publication Data

US 2010/0141645 A1 Jun. 10, 2010

(30) Foreign Application Priority Data

Dec. 5, 2008 (KR) ..... 10-2008-0123141

(51) Int. Cl.
*G09G 5/00* (2006.01)
*G09G 3/30* (2006.01)

(52) U.S. Cl. ..... 345/214; 345/76; 345/80

(58) Field of Classification Search ..... 345/78–80, 345/82, 84, 92, 95, 98–101, 204, 214, 76
See application file for complete search history.

(56) References Cited

U.S. PATENT DOCUMENTS

| | | | | |
|---|---|---|---|---|
| 7,180,486 | B2 * | 2/2007 | Jeong | 345/82 |
| 7,193,370 | B2 * | 3/2007 | Kim | 315/169.1 |
| 7,310,078 | B2 * | 12/2007 | Kim | 345/76 |
| 2005/0156829 | A1 | 7/2005 | Choi et al. | |
| 2006/0145967 | A1 | 7/2006 | Huh | |
| 2006/0232678 | A1 * | 10/2006 | Choi et al. | 348/207.11 |
| 2006/0253755 | A1 | 11/2006 | Wu | |
| 2008/0170009 | A1 * | 7/2008 | Eom | 345/76 |

FOREIGN PATENT DOCUMENTS

| | | | |
|---|---|---|---|
| JP | 2007-140318 | | 6/2007 |
| JP | 2008-026467 | | 2/2008 |
| KR | 1020060114537 | A | 11/2006 |
| KR | 10-2007-0112714 | | 11/2007 |
| KR | 100833760 | B1 | 5/2008 |
| KR | 1020080050113 | A | 6/2008 |
| KR | 1020080080734 | A | 9/2008 |

OTHER PUBLICATIONS

Korean Office Action dated Sep. 6, 2010 for the corresponding Korean priority application No. 10-2008-0123141 and a Request for Entry of the Accompanying Office Action herewith.

* cited by examiner

*Primary Examiner* — Hoa T Nguyen
*Assistant Examiner* — Andrew Sasinowski
(74) *Attorney, Agent, or Firm* — Robert E. Bushnell, Esq.

(57) ABSTRACT

An organic light emitting display device capable of driving transistor threshold voltage compensation, including: pixels positioned in the intersections of scan lines and data lines, wherein each pixel comprises: a first transistor and a fourth transistor, connected at a common node, disposed between an anode of an OLED and a first power supply; a cathode of the OLED connected to a second power supply; a second transistor connected between a gate of the first transistor and a data line, and turned on when a scan signal is supplied to a scan line; a third transistor connected between the common node and the data line, and turned on when a scan signal is supplied to the scan line; a first capacitor connected between the gate of the first transistor and the anode of the OLED; and a second capacitor connected between the anode of the OLED and a predetermined voltage source.

16 Claims, 4 Drawing Sheets

ORGANIC LIGHT EMITTING DISPLAY DEVICE AND METHOD OF DRIVING THE SAME

CROSS REFERENCE TO RELATED APPLICATIONS

This application makes reference to, incorporates the same herein, and claims all benefits accruing under 35 U.S.C §119 from an application entitled ORGANIC LIGHT EMITTING DISPLAY DEVICE AND METHOD OF DRIVING THE SAME earlier filed in the Korean Industrial Property Office on 5 Dec. 2008, which was duly assigned Serial No. 10-2008-0123141 by that Office.

BACKGROUND OF THE INVENTION

1. Field of the Invention

The present invention relates to an organic light emitting display device and a method of driving the same, and more particularly to an organic light emitting display device capable of compensating for threshold voltage of a driving transistor and a method of driving the same.

2. Discussion of Related Art

Recently, various flat panel display devices capable of reduced in weight and volume over cathode ray tubes have been developed. As the flat panel display device, there are a liquid crystal display device, a field emission display device, a plasma display panel, an organic light emitting display device, etc.

Among others, the organic light emitting display device displays images by using an organic light emitting diode generating light by means of recombination of electrons and holes. Such an organic light emitting diode has advantages of being driven with low power consumption and having rapid response speed.

FIG. 1 is a circuit diagram showing a pixel of a general organic light emitting display device. In FIG. 1, transistors included in pixels are set as NMOS transistors.

Referring to FIG. 1, a pixel 4 of the conventional organic light emitting display device includes an organic light emitting diode OLED and a pixel circuit 2 coupled to a data line Dm and a scan line Sn to control the organic light emitting diode OLED.

An anode electrode of the organic light emitting diode OLED is connected to an anode electrode, and a cathode electrode thereof is connected to a second power supply ELVSS. The organic light emitting diode OLED as above generates light having a predetermined brightness, corresponding to current supplied from the pixel circuit.

The pixel circuit 2 controls the amount of current supplied to the organic light emitting diode OLED by corresponding to a data signal supplied to the data line Dm when a scan signal is supplied to the scan line Sn. To this end, the pixel circuit 2 includes a second transistor M2 (that is, a driving transistor) connected between a first power supply ELVDD and the organic light emitting diode OLED, a first transistor M1 connected among the second transistor M2, the data line Dm and the scan line Sn, and a storage capacitor Cst connected between a gate electrode and a second electrode of the second transistor M2.

A gate electrode of the first transistor M1 is connected to the scan line Sn, and a first electrode thereof is connected to the data line Dm. A second electrode of the first transistor M1 is connected to one terminal of the storage capacitor Cst. Here, the first electrode is set as any one of a source electrode and a drain electrode, and the second electrode is set as the other electrode than the first electrode. For example, if the first electrode is set as a drain electrode, the second electrode is set as a source electrode. When the scan signal is supplied from the scan line Sn, the first transistor M1 connected to the scan line Sn and the data line Dm is turned on to supply the data signal supplied from the data line Dm to the storage capacitor Cst. At this time, the storage capacitor Cst is charged with voltage corresponding to the data signal.

A gate electrode of the second transistor M2 is connected to one terminal of the storage capacitor Cst and a first electrode thereof is connected to the first power supply ELVDD. A second electrode of the second transistor M2 is connected to the other terminal of the storage capacitor Cst and the anode electrode of the organic light emitting diode OLED. The second transistor M2 as above controls the amount of current flowing onto a second power supply ELVSS from the first power supply ELVDD via the organic light emitting diode OLED, corresponding to the voltage value stored in the storage capacitor Cst.

One terminal of the storage capacitor Cst is connected to the gate electrode of the second transistor M2, and the other terminal thereof is connected to the anode electrode of the organic light emitting diode OLED. The storage capacitor Cst as above is charged with voltage corresponding to the data signal.

The conventional pixel 4 as above supplies the current corresponding to the voltage charged in the storage capacitor Cst to the organic light emitting diode OLED, thereby displaying images having a predetermined brightness. However, the conventional organic light emitting display device as above has a problem that images having even brightness cannot be displayed due to deviation of threshold voltage.

When the threshold voltage of the second transistor M2 is actually set to be different for each pixel 4, each pixel 4 generates light having different brightness by corresponding to the same data signal so that images having even brightness cannot be displayed.

SUMMARY OF THE INVENTION

Therefore, it is an object of the present invention to provide an organic light emitting display device capable of compensating for threshold voltage of a driving transistor, and a method of driving the same.

In order to accomplish the above object, according to an embodiment of the present invention, there is provided an organic light emitting display device including: a scan driver supplying scan signals to scan lines; a data driver supplying reference power to data lines during a primary period of a period while the scan signals are supplied, and supplying data signals during a secondary period of the period other than the primary period; and pixels positioned in the intersections of the scan lines and the data lines, wherein a pixel positioned in an $i^{th}$ (i is a natural number) horizontal line comprises: an organic light emitting diode whose cathode electrode is connected to a second power supply; a first transistor and a fourth transistor connected between an anode electrode of an organic light emitting diode and a first power supply; a second transistor connected between a gate electrode of the first transistor and a data line, and turned on when a scan signal is supplied to an $i^{th}$ scan line; a third transistor connected between a common node of the first transistor and the fourth transistor and the data line, and turned on when a scan signal is supplied to the $i^{th}$ scan line; a first capacitor connected between the gate electrode of the first transistor and the anode electrode of the organic light emitting diode; and a second capacitor connected between the anode electrode of the organic light emitting diode and a predetermined voltage source.

Preferably, a gate electrode of the fourth transistor is connected to the gate electrode of the first transistor. A voltage value obtained by subtracting a threshold voltage of the first transistor from a voltage of the reference power supply is set to be lower than a threshold voltage of the organic light emitting diode. The second capacitor is set to have a lower capacity than the first capacitor. The secondary period is set so that a voltage of the anode electrode of the organic light emitting diode does not rise to a voltage obtained by subtracting the threshold voltage from a voltage applied to the gate electrode of the first transistor. The organic light emitting diode further includes a fifth transistor connected between the anode electrode of the organic light emitting diode and an initialization power supply, and turned on when the scan signal is supplied to an i-1$^{st}$ scan line.

According to an embodiment of the present invention, there is provided a method of driving an organic light emitting display device comprising: setting a voltage of an anode electrode of an organic light emitting diode to be lower than a threshold voltage of the organic light emitting diode; supplying a voltage of a reference power supply to a gate electrode and a first electrode of a driving transistor connected to the organic light emitting diode to raise the voltage of the anode electrode of the organic light emitting diode to a voltage obtained by subtracting a threshold voltage of the driving transistor from the reference power; supplying data signals to a gate electrode of the driving transistor; raising the voltage of the anode electrode of the organic light emitting diode to voltage lower than rising voltage of the gate electrode of the driving transistor using a first capacitor and a second capacitor connected in series between the gate electrode of the driving transistor and a cathode electrode of the organic light emitting diode; and implementing a gray scale by stopping the supply of the data signals before the voltage of the anode electrode of the organic light emitting diode rises to the values obtained by subtracting the threshold voltage of the driving transistor from the voltage of the gate electrode of the driving transistor.

Preferably, the voltage value of the reference power supply is set so that the voltage obtained by subtracting the threshold voltage of the driving transistor from the reference power is set to be lower than the threshold voltage of the organic light emitting diode.

With the organic light emitting diode and the method of driving the same according to the present invention, the amount of current flowing onto the organic light emitting diode is determined regardless of the threshold voltage of the transistor, making it possible to display images having an even brightness. Also, image having a desired brightness can be displayed by compensating for characteristic deviation of the transistor.

BRIEF DESCRIPTION OF THE DRAWINGS

A more complete appreciation of the present invention, and many of the attendant advantages thereof, will become readily apparent as the same becomes better understood by reference to the following detailed description when considered in conjunction with the accompanying drawings in which like reference symbols indicate the same or similar components, wherein.

DETAILED DESCRIPTION OF PREFERRED EMBODIMENTS

Figure 1:
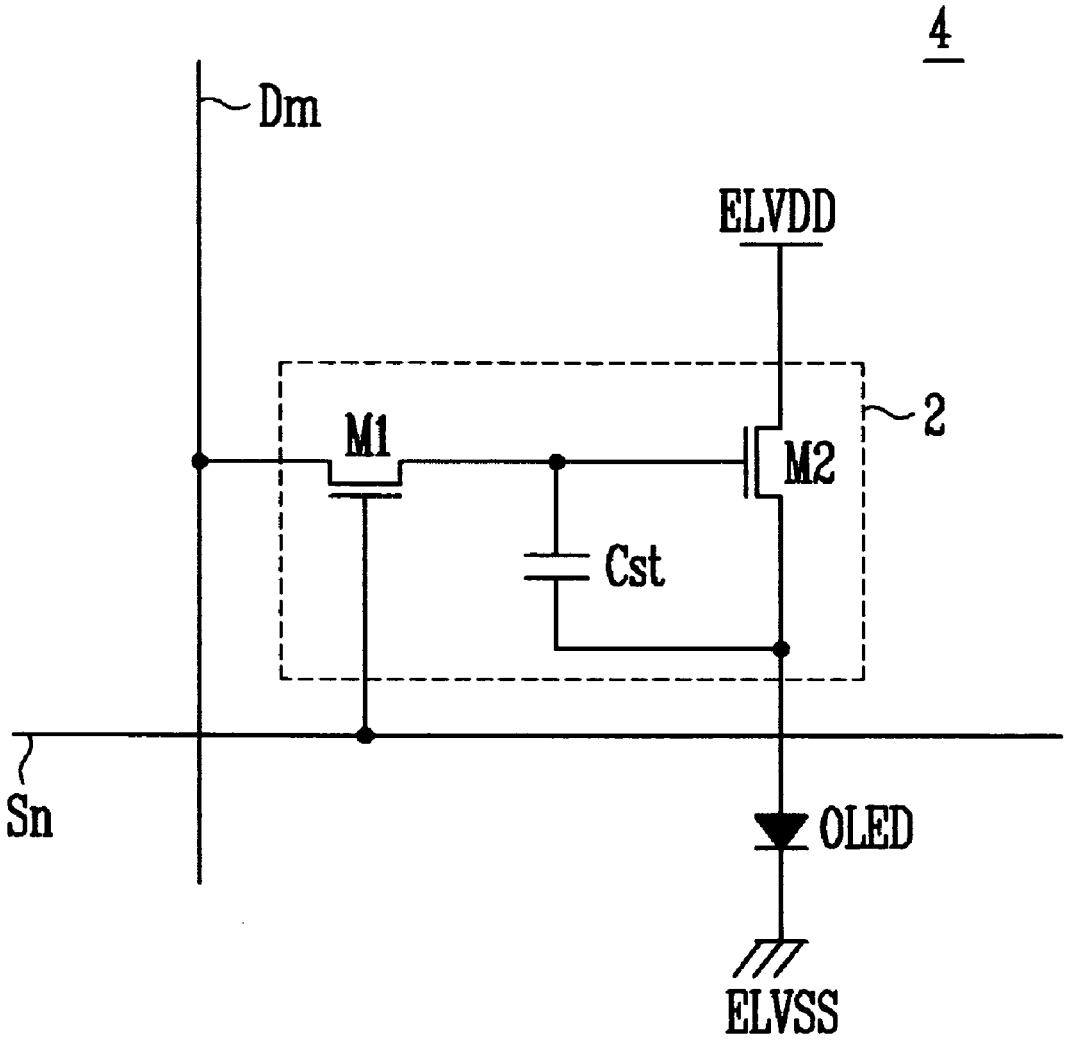
FIG. 1 (BACKGROUND ART)
FIG. 1 is a circuit diagram showing a pixel of a general organic light emitting display device.

Hereinafter, certain exemplary embodiments according to the present invention will be described with reference to the accompanying drawings. Here, when a first element is described as being coupled to a second element, the first element may be not only directly coupled to the second element but may also be indirectly coupled to the second element via a third element. Further, some of the elements that are not essential to the complete understanding of the invention are omitted for clarity. Also, like reference numerals refer to like elements throughout.

Hereinafter, the present invention will be described in more detail with reference to FIGS. 2 to 6 attached with exemplary embodiments so that a person having ordinary skill in the art to which the present invention pertains can readily carry out the present invention.

Figure 2:
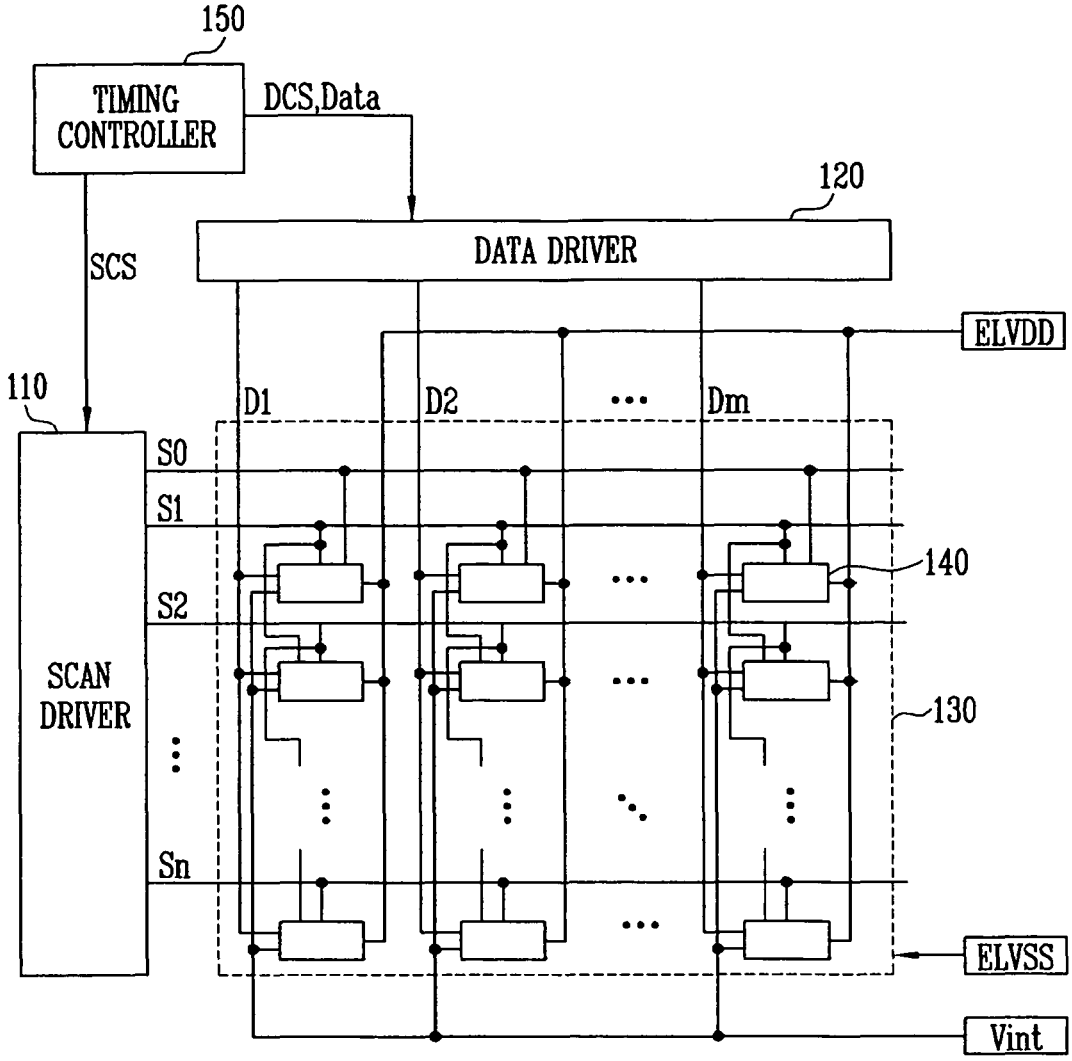
FIG. 2 shows an organic light emitting display device according to an embodiment of the present invention.

FIG. 2 shows an organic light emitting display device according to an embodiment of the present invention.

Referring to FIG. 2, the organic light emitting display device includes pixels 140 positioned to be connected to scan lines S0 to Sn and data lines D1 to Dm, a scan driver 110 driving the scan lines S0 to Sn, a data driver 120 driving the data lines D1 to Dm, and a timing controller 150 controlling the scan driver 110 and the data driver 120.

The scan driver 110 receives scan driving control signals SCS from the timing controller 150. The scan driver 110 having received the scan driving control signals SCS generates scan signals and supplies the generated scan signals sequentially to the scan lines S0 to Sn.

The data driver 120 receives data driving control signals DCS from the timing controller 150. The data driver 120 having received the data driving control signals DCS supplies reference voltage to the data lines D1 to Dm during a primary period of a period while the scan signals are supplied, and supplies data signals to the data lines D1 to Dm during periods other than the primary period. Here, the reference power is set so that the voltage obtained by subtracting a threshold voltage from a voltage of a reference power supply is lower than a threshold voltage of the organic light emitting diode.

The timing controller 150 generates the data driving control signals DCS and the scan driving control signals SCS by corresponding to synchronization signals supplied from the external. The data driving control signals DCS generated by the timing controller 150 are supplied to the data driver 120, and the scan driving control signals SCS generated therefrom are supplied to the scan driver 110. The timing controller supplies the data supplied from the external to the data driver 120.

The pixel unit 130 receives first power ELVDD, second power ELVSS and initialization power Vint to supply them to respective pixels 140. The respective pixels having received the first power ELVDD, the second power ELVSS and the initialization power Vint generate light corresponding to the data signals.

Here, the first power ELVDD is set to have a higher voltage value than the second power ELVSS to supply a predetermined current to an organic light emitting diode. The initialization voltage Vint, which is voltage supplied to an anode electrode of the organic light emitting diode, is set to be lower than the voltage obtained by subtracting the threshold voltage of a first transistor from a reference power.

Meanwhile, a pixel 140 positioned on an $i^{th}$ (i is a natural number) horizontal line is connected to an $i^{th}$ scan line and an $i\text{-}1^{st}$ scan line. Such a pixel 140 includes a plurality of NMOS transistors and supplies current compensating for the threshold voltage of a driving transistor to the organic light emitting diode.

Figure 3:
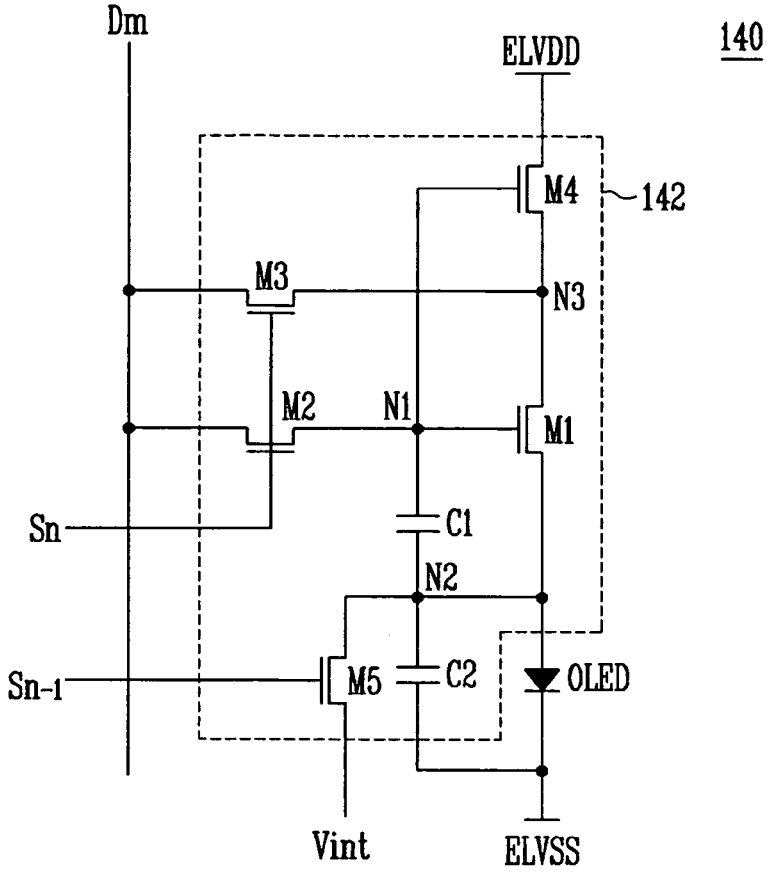
FIG. 3 shows a first embodiment of the pixel of FIG. 2.

FIG. 3 shows a first embodiment of the pixel 140 of FIG. 2. For convenience of explanation, a pixel 140 is positioned in an $n^{th}$ horizontal line and connected to an $m^{th}$ data line Dm will be described.

Referring to FIG. 3, the pixel 140, according to the first embodiment, includes an organic light emitting diode OLED and a pixel circuit 142 connected to a data line Dm and scan lines Sn−1 and Sn to control the organic light emitting diode OLED.

An anode electrode of the organic light emitting diode OLED is connected to the pixel circuit 142, and a cathode electrode thereof is connected to a second power supply ELVSS. The organic light emitting diode OLED as above generates light having a predetermined brightness, corresponding to current supplied from the pixel circuit 142.

The pixel circuit 142 is charged with a voltage corresponding to a data signal supplied to the data line Dm when a scan signal is supplied to the scan line Sn and voltage corresponding to threshold voltage of a first transistor M1, and controls the amount of current supplied to the organic light emitting diode OLED corresponding to the charged voltage. To this end, the pixel circuit 142 includes first to fifth transistors M1 to M5, a first capacitor C1 and a second capacitor C2.

A gate electrode of the first transistor M1 is connected to a first node N1, and a first electrode thereof is connected to a third node N3. A second electrode of the first transistor M1 is connected to an anode electrode (that is, a second node N2) of the organic light emitting diode OLED.

A gate electrode of the second transistor M2 is connected to the scan line Sn, and a first electrode thereof is connected to the data line Dm. A second electrode of the second transistor M2 is connected to the first node N1 (that is, the gate electrode of the first transistor M1). When the scan signal is supplied to the scan line Sn, the second transistor M2 as above is turned on to electrically connect the data line Dm to the first node N1.

A gate electrode of the third transistor M3 is connected to the scan line Sn, and a first electrode thereof is connected to the data line Dm. A second electrode of the third transistor M3 is connected to the third node N3 (that is, the first electrode of the first electrode M1). When the scan signal is supplied to the scan line Sn, the third transistor M3 as above is turned on to electrically connect the data line Dm to the third node N3.

A gate electrode of the fourth transistor M4 is connected to the first node N1, and a first electrode thereof is connected to the first power supply ELVDD. A second electrode of the fourth transistor M4 is connected to the third node N3. The fourth transistor M4 keeps a turn-off state by means of voltage applied to the first node N1 and the third node N3 while the first capacitor C1 is charged with a predetermined voltage. The fourth transistor M4 supplies the third node N3 current corresponding to the current applied to the first node N1 after the first capacitor C1 is charged with a predetermined voltage. Here, threshold voltage of the first transistor M1 and the fourth transistor M4 included in the same pixel 140 is set to be approximately the same so that the amount of current supplied to the third node N3 is controlled, regardless of the threshold voltage. The detailed description thereof will be described later.

A gate electrode of the fifth transistor M5 is connected to the n−1 scan line Sn−1, and a first electrode thereof is connected to the second node N2. A second electrode of the fifth transistor M5 is connected to the initialization power supply Vint. When the scan signal is supplied to the n−1 scan line Sn−1, the fifth transistor M5 is turned on to electrically connect the second node N2 to the initialization power supply Vint.

The first capacitor C1 is connected between the first node N1 and the second node N2. The first capacitor C1 as above is charged with the threshold voltage of the first transistor M1 and the voltage corresponding to the data signal supplied to the data line Dm.

The second capacitor C2 is connected between the second node N2 and the second power supply ELVSS. The second capacitor C2 controls rising voltage of the second node N2 so that the voltage corresponding to the data signal can be charged in the first capacitor C1.

Figure 4:
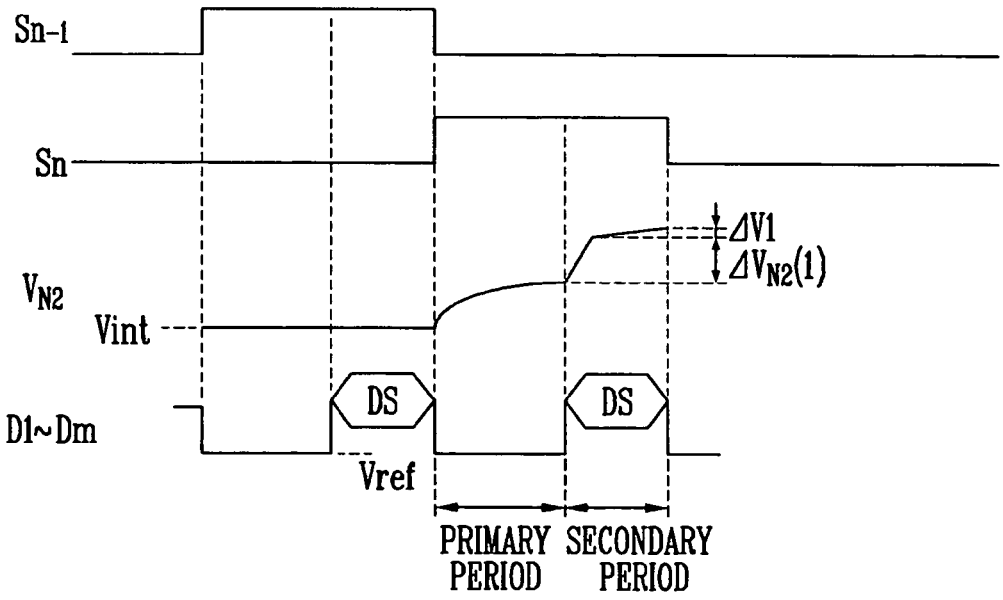
FIG. 4 is a waveform view showing a method of driving the pixel of FIG. 3.

FIG. 4 is a waveform view showing a method of driving the pixel of FIG. 3.

Specifically describing the operation process of the pixel 140 of FIG. 3 by combining FIGS. 3 and 4, the scan signal is first supplied to the n−1 scan line Sn−1 so that the fifth transistor M5 is turned on. If the fifth transistor M5 is turned on, the second node N2 is electrically connected to the initialization power supply Vint. At this time, the second node N2 is initialized as voltage of the initialization power supply Vint. Here, the initialization power Vint is set to have voltage lower than the threshold voltage of the organic light emitting diode OLED and thus, unnecessary light is not generated in the organic light emitting diode OLED.

Thereafter, the scan signal is supplied to the scan line Sn. If the scan signal is supplied to the scan line Sn, the second transistor M2 and the third transistor M3 are turned on. If the second transistor M2 and the third transistor M3 are turned on, the reference power Vref supplied to the data line Dm during a primary period of a period while the scan signal is supplied is supplied to the first node N1 and the third node N3.

Here, the first node N1 and the third node N3 are set to have the same voltage (that is, a reference power Vref) so that the fourth transistor M4 is turned off. The first transistor M1 is connected in a diode shape so that the voltage of the second node N2 rises to the voltage obtained by subtracting the threshold voltage Vth of the first transistor M1 from the reference power Vref (that is, Vref−Vth (M1)). Here, the voltage of Vref−Vth (M1) is set to be lower than the threshold voltage of the organic light emitting diode OLED and thus, unnecessary light is not generated in the organic light emitting diode OLED.

Meanwhile, the voltage of the reference power Vref is applied to the first node N1 and the voltage obtained by subtracting the threshold voltage Vth of the first transistor M1 from the reference power Vref is applied to the second node N2, such that the voltage corresponding to the threshold voltage Vth of the first transistor M1 is charged in the first capacitor C1.

Therefore, the data signal DS is supplied to the data line Dm during a secondary period of the period while the scan signal is supplied. If the data signal is supplied to the data line Dm, the voltage of the first node N1 rises from the reference power Vref to the voltage of the data signal DS. In other words, the voltage of the first node N1 may be represented using equation 1 below.

$$V_{N1}=V\text{data}-V\text{ref} \quad \text{Equation 1}$$

Here, Vdata represents the voltage of the data signal DS.

When the voltage of the first node N1 is changed as shown in equation 1, the voltage variation of the second node N2 may be represented as shown in equation 2 below, by a coupling phenomenon of the first capacitor C1.

$$\Delta V_{N2}(1)=\{C1/(C1+C2)\}\times(V\text{data}-V\text{ref}) \quad \text{Equation 2}$$

When the voltage of the second node N2 is changed as shown in equation 2, the value of the voltage between the gate and source electrode Vgs of the first transistor M1 rises from its threshold voltage by a predetermined voltage. In this case, a predetermined current flows by the first transistor M1 so that the voltage of the second node N2 is changed by the voltage ΔV1.

Here, the voltage ΔV1 is set to be different for each pixel according to the characteristics (for example, mobility) of the first transistor M1 and thus, the characteristic deviation of the first transistor M1 can be compensated. Actually, when the voltage of the second node N2 is changed by the voltage ΔV1, the voltage between the gate and source electrode of the first transistor M1 may be represented by equation 3 below.

$$Vgs(M1)=(V\text{data}-V\text{ref})\{1-C1(C1+C2)-\Delta V1\}+Vth(M1) \quad \text{Equation 3}$$

Through equation 3 it is shown that the current flowing onto the organic light emitting diode OLED may be represented by equation 4 below.

$$I_{OLED}=\beta(Vgs(M1)-Vth(M1))^2=\beta\{(V\text{data}-V\text{ref})\{1-C1(C1+C2)-\Delta V1\}\}^2 \quad \text{Equation 4}$$

Here, β refers to a constant value.

Referring to FIG. 4, the current flowing onto the organic light emitting diode OLED is determined, regardless of the threshold voltage of the first transistor M1. Therefore, the present invention can display images having a desired brightness, regardless of the threshold voltage of the first transistor M1. Also, the current flowing onto the organic light emitting diode OLED is affected by the voltage ΔV1. Here, the voltage values of ΔV1 is determined by the deviation of the first transistor M1 so that the effect by the deviation of the first transistor M1 can be compensated.

Meanwhile, if the supply of the scan signal to the scan line Sn is stopped, the second transistor M2 and the third transistor M3 are turned off. In this case, the fourth transistor M4 supplies the current corresponding to the voltage applied to the first node N1 to the third node N3. The particular deviation and the threshold voltage of the fourth transistor M4, which is positioned in the same pixel as the first transistor M1, are set to be almost the same as those of the first transistor M1. Therefore, the current supplied from the fourth transistor M4 to the third node N3 is determined as shown in equation 4.

The first transistor M1 supplies the current supplied to the third node N3 to the organic light emitting diode OLED. Then, the organic light emitting diode OLED generates light having a predetermined brightness.

Meanwhile, when the secondary period of the period while the scan signal is supplied is set to be long, the voltage of the second node N2 rises to the voltage obtained by subtracting the threshold voltage of the first transistor M1 from the voltage applied to the first node N1. Therefore, the secondary period, that is, the turn-off time point of the scan signal, is set to the voltage value before the voltage of the second node N2 rises to the value obtained by the threshold voltage from the voltage of the first node N1. Actually, the secondary period is experimentally determined in consideration of characteristics, process conditions and design deviation of the transistor.

In the present invention, the second capacitor C2 keeps the rising voltage of the second node N2 smaller than the rising voltage of the first node N1, such that gray scale cannot be displayed. More specifically, when the second capacitor C2 is removed, the first capacitor C1 is charged with the voltage corresponding to the threshold voltage of the first transistor M1 regardless of the supply of the data signal, such that the gray scale cannot be displayed. Therefore, the present invention controls the rising voltage of the second node N2 using the second capacitor C2, such that the gray scale can be displayed. To this end, the second capacitor C2 is set to have a lower capacity than the first capacitor C1 (that is, C1>C2).

Figure 5:
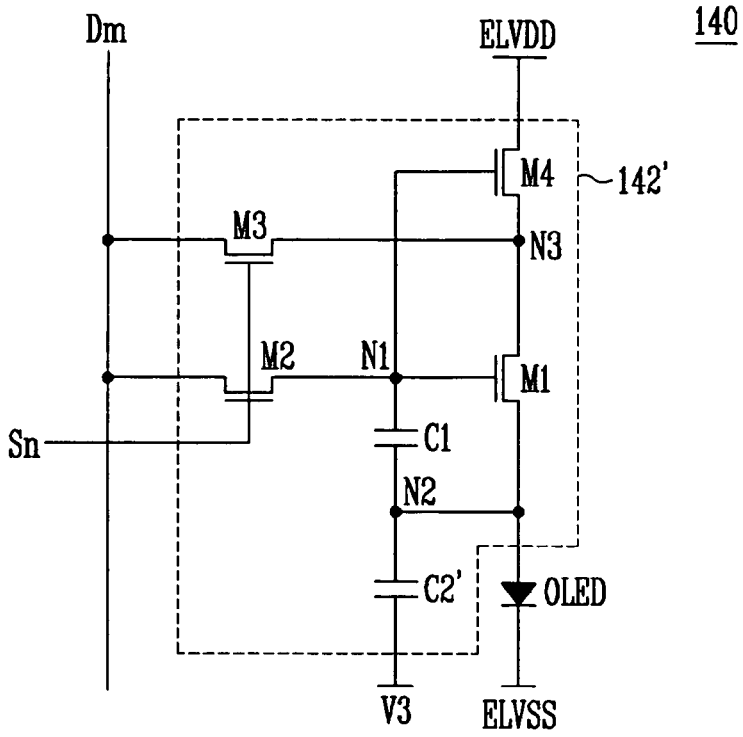
FIG. 5 shows a second embodiment of the pixel of FIG. 2.

FIG. 5 shows a second embodiment of the pixel of FIG. 2. When describing FIG. 5, the same reference numerals will be given to the same constitution of FIG. 3 and the detailed description thereof will be omitted.

Referring to FIG. 5, the pixel according to the second embodiment includes an organic light emitting diode OLED and a pixel circuit 142' connected to a data line Dm and a scan line Sn to control the organic light emitting diode OLED.

An anode electrode of the organic light emitting diode OLED is connected to the pixel circuit 142' at node N2, and a cathode electrode thereof is connected to a second power supply ELVSS. The organic light emitting diode OLED as above generates light having a predetermined brightness, corresponding to current supplied from the pixel circuit 142'.

The pixel circuit 142' is charged with a voltage corresponding to a data signal supplied to the data line Dm when a scan signal is supplied to the scan line Sn and voltage corresponding to threshold voltage of a first transistor, and controls the amount of current supplied to the organic light emitting diode OLED corresponding to the charged voltage. To this end, the pixel circuit 142' includes first to fifth transistors M1 to M5, a first capacitor C1 and a second capacitor C2'.

The second capacitor C2' is positioned between a second node N2 and a third power supply V3. Here, the third power supply V3 swings through a high and a low voltage. In other words, as shown in FIG. 6, the third power supply V3 connected to the pixel 140 positioned in the nth horizontal line maintains a low voltage only during a period overlapping with a period while the scan signal is supplied to the scan line Sn, and maintains a high voltage during periods other than the period.

Comparing the pixel 140 according to the second embodiment of the present invention with the pixel 140 according to the first embodiment of the present invention, the fifth transistor M5 is omitted and the second capacitor C2 is connected to the third power supply V3 in the second embodiment. In other words, the organic light emitting diode OLED is initialized using the third power supply V3 in the second embodiment.

Figure 6:
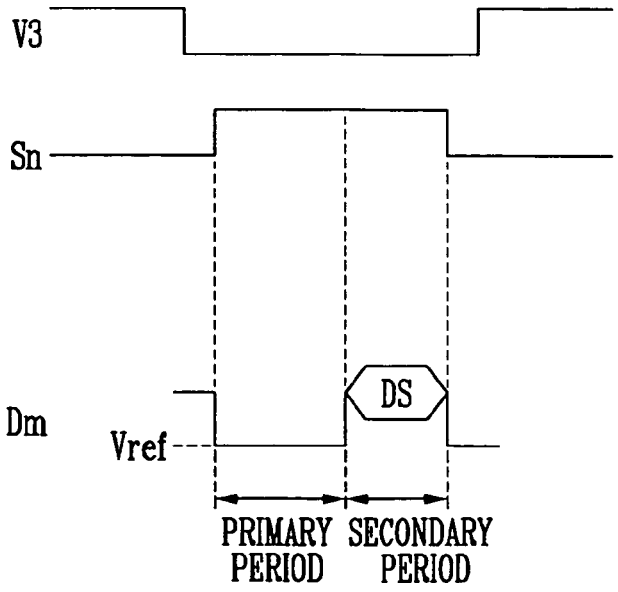
FIG. 6 is a waveform view showing a method of driving the pixel of FIG. 5.

FIG. 6 is a waveform view showing a method of driving the pixel of FIG. 5.

Specifically describing the operation process of the pixel 140 of FIG. 5 by combining FIGS. 5 and 6, the voltage of the third power supply V3 is first fallen to a low voltage. If the voltage of the third power supply V3 is fallen, the voltage of the second node N2 is also fallen by a coupling phenomenon of the second capacitor C2'. At this time, the voltage values of the low voltage of the third power supply V3 are set so that the voltage of the second node N2 is set to be lower than voltage obtained by subtracting the threshold voltage of the first transistor M1 from the voltage of the reference power supply Vref.

Thereafter, the second transistor M2 and the third transistor M3 are turned on by the scan signal supplied to the scan line Sn. If the second transistor M2 and the third transistor M3 are turned on, the reference power Vref, supplied to the data line Dm during the primary period of the period while the scan signal is supplied, is supplied to the first node N1 and the third node N3.

Here, the first node N1 and the third node N3 are set to have the same voltage (that is, the reference power Vref) so that the fourth transistor M4 is turned off. The first transistor M1 is connected in a diode shape so that the voltage of the second node N2 rises to the voltage obtained by subtracting the threshold voltage of the first transistor M1 from the reference power Vref (that is, Vref−Vth (M1)). Here, the voltage of Vref−Vth (M1) is set to be lower than the threshold voltage of the organic light emitting diode OLED and thus, unnecessary light is not generated in the organic light emitting diode OLED.

Meanwhile, the voltage of the reference power supply Vref is applied to the first node N1 and the voltage obtained by subtracting the threshold voltage of the first transistor M1 from the reference power Vref is applied to the second node N2, such that the voltage corresponding to the threshold voltage of the first transistor M1 is charged in the first capacitor C1.

Therefore, the data signal Ds is supplied to the data line Dm during a secondary period of the period while the scan signal is supplied. If the data signal DS is supplied to the data line Dm, the voltage of the first node N1 is determined as shown in the equation 1. When the voltage of the first node N1 is changed as shown in the above equation 1, voltage variation of the second node N2 is changed as shown in the above equation 2 by a coupling phenomenon of the first capacitor C1.

Here, when the voltage of the second node N2 is changed into the voltage ΔV1, the voltage between the gate and source electrode of the first transistor M1 may be represented by the above equation 3. The current flowing onto the organic light emitting diode OLED may be represented by the above equation 4.

Thereafter, the supply of the scan signal to the scan line Sn is stopped, such that the second transistor M2 and the third transistor M3 are turned off. The voltage of the third power supply V3 rises to a high voltage. Here, since the first node N1 is set to be in a floating state, the voltage charged in the first capacitor C1 maintains the voltage charged prior to the previous period, although the voltage of the third power supply V3 rises to the high voltage. In other words, the voltage Vgs of the first transistor M1 maintains the voltage charged during the previous period regardless of the rising voltage of the third power supply V3, thereby making it possible to provide desired current to the organic light emitting diode OLED.

While the present invention has been described in connection with certain exemplary embodiments, it is to be understood that the invention is not limited to the disclosed embodiment, but, on the contrary, is intended to cover various modifications and equivalent arrangements included within the spirit and scope of the appended claims, and equivalents thereof.

What is claimed is:

1. An organic light emitting diode comprising:

a scan driver supplying scan signals to scan lines;

a data driver supplying reference power to data lines during a primary period of a period while the scan signals are supplied, and supplying data signals during a secondary period of the period other than the primary period; and a plurality of pixels positioned in the intersections of the scan lines and the data lines, wherein each pixel comprises:

an organic light emitting diode whose cathode electrode is connected to a second power supply;

a first transistor and a fourth transistor connected between an anode electrode of an organic light emitting diode and a first power supply;

a second transistor connected between a gate electrode of the first transistor and the data line, and turned on when a scan signal is supplied to a first scan line;

a third transistor connected between a common node of the first transistor and the fourth transistor and the data line, and turned on when a scan signal is supplied to the first scan line;

a first capacitor connected between the gate electrode of the first transistor and the anode electrode of the organic light emitting diode; and a second capacitor connected between the anode electrode of the organic light emitting diode and a predetermined voltage source.

2. The organic light emitting diode according to claim 1, wherein a gate electrode of the fourth transistor is connected to the gate electrode of the first transistor.

3. The organic light emitting diode according to claim 1, wherein a voltage value obtained by subtracting a threshold voltage of the first transistor from a voltage of the reference power supply is set to be lower than a threshold voltage of the organic light emitting diode.

4. The organic light emitting diode according to claim 1, wherein the second capacitor is set to have a lower capacity than the first capacitor.

5. The organic light emitting diode according to claim 1, wherein the secondary period is set so that a voltage of the anode electrode of the organic light emitting diode does not rise to a voltage obtained by subtracting the threshold voltage from a voltage applied to the gate electrode of the first transistor.

6. The organic light emitting diode according to claim 1, wherein the first to fourth transistors are formed in an NMOS type.

7. The organic light emitting diode according to claim 1, wherein the predetermined voltage source is a second power supply.

8. The organic light emitting diode according to claim 7, further comprising:

a fifth transistor connected between the anode electrode of the organic light emitting diode and an initialization power supply, and turned on when a scan signal is supplied to a preceding adjacent scan line.

9. The organic light emitting diode according to claim 8, wherein a voltage of the initialization power supply is set to be lower than voltage obtained by subtracting the threshold voltage of the first transistor from the reference power.

10. The organic light emitting diode according to claim 8, wherein the fifth transistor is formed in an NMOS type.

11. The organic light emitting diode according to claim 1, wherein the predetermined voltage source is a third power supply which swings through a high voltage and a low voltage.

12. The organic light emitting diode according to claim 11, wherein the third power supply maintains the low voltage so as to overlap with the scan signal supplied to the first scan line, and maintains the high voltage during a period other than the period.

13. The organic light emitting diode according to claim 12, wherein the voltage value of the low voltage of the third power supply is set so that the voltage of the anode electrode of the organic light emitting diode is set to be lower than the voltage obtained by subtracting the threshold voltage of the first transistor from the reference power.

14. A method of driving an organic light emitting display device comprising:

setting a voltage of an anode electrode of an organic light emitting diode to be lower than a threshold voltage of the organic light emitting diode;

supplying a voltage of a reference power supply to a gate electrode and a first electrode of a driving transistor connected to the organic light emitting diode to raise the voltage of the anode electrode of the organic light emitting diode to a voltage obtained by subtracting a threshold voltage of the driving transistor from the reference power;

supplying data signals to a gate electrode of the driving transistor;

raising the voltage of the anode electrode of the organic light emitting diode to a voltage lower than a voltage rise of the gate electrode of the driving transistor using a first capacitor and a second capacitor connected in series between the gate electrode of the driving transistor and a cathode electrode of the organic light emitting diode; and implementing a gray scale by stopping the supply of the data signals before the voltage of the anode electrode of the organic light emitting diode rises to the values obtained by subtracting the threshold voltage of the driving transistor from the voltage of the gate electrode of the driving transistor.

15. The method of driving the organic light emitting display device according to claim 14, wherein the voltage value of the reference power supply is set so that the voltage obtained by subtracting the threshold voltage of the driving transistor from the reference power is set to be lower than the threshold voltage of the organic light emitting diode.

16. The method of driving the organic light emitting display device according to claim 14, wherein a common terminal of the first capacitor and the second capacitor is connected to the anode electrode of the organic light emitting diode.

* * * * *